United States Patent [19]

Wagenmakers

[11] 4,424,835

[45] Jan. 10, 1984

[54] WEAVING ERROR CORRECTION DEVICE FOR SHUTTLELESS WEAVING MACHINE

[75] Inventor: Harry Wagenmakers, Deurne, Netherlands

[73] Assignee: Ruti-Te Strake B.V., Netherlands

[21] Appl. No.: 315,132

[22] Filed: Oct. 26, 1981

[30] Foreign Application Priority Data

Oct. 28, 1981 [NL] Netherlands ..... 8005904

[51] Int. Cl.[3] ..... D03D 51/08

[52] U.S. Cl. ..... 139/1 E

[58] Field of Search ..... 139/1 R, 1 E, 336, 452

[56] References Cited

U.S. PATENT DOCUMENTS

| | | | |
|---|---|---|---|
| 3,661,185 | 5/1972 | Fumat | 139/1 E |
| 3,805,850 | 4/1974 | Van Duynhoven et al. | 139/1 E |

FOREIGN PATENT DOCUMENTS

| | | | |
|---|---|---|---|
| 2509665 | 9/1976 | Fed. Rep. of Germany | 139/1 E |
| 2714210 | 10/1977 | Fed. Rep. of Germany | 139/1 R |
| 2935507 | 3/1981 | Fed. Rep. of Germany | 139/1 E |
| 683406 | 11/1952 | United Kingdom | 139/1 E |
| 724611 | 3/1980 | U.S.S.R. | 139/1 E |

*Primary Examiner*—James Kee Chi

*Attorney, Agent, or Firm*—C. O. Marshall, Jr.

[57] ABSTRACT

A shuttleless weaving machine has a shedding mechanism, a weft conveyor for launching a weft thread through a weaving shed provided by the shedding mechanism, and a plural weft preparation device for delivering weft threads according to a repeating pattern to the weft conveyor. There is a disconnectable coupling between the plural weft preparation device and the shedding mechanism. An angular position comparator includes a part coupled to the shedding mechanism and a part coupled to the plural weft preparation device, said parts assuming a marked angular position relative to each other during normal operation while rotating through 1/(an) revolution per weaving cycle (a=number of wefts after which the weft pattern is repeated, and n=number of marked angular positions). Means are provided for detecting such marked relative angular position of the two parts, which means operate, while such position is not detected, to disconnect said coupling. An auxiliary motor is connected to the plural weft preparation device, for driving said device and the part of the comparator coupled thereto to bring said part to a marked angular position relative to said other part.

3 Claims, 2 Drawing Figures

WEAVING ERROR CORRECTION DEVICE FOR SHUTTLELESS WEAVING MACHINE

Figure 1:
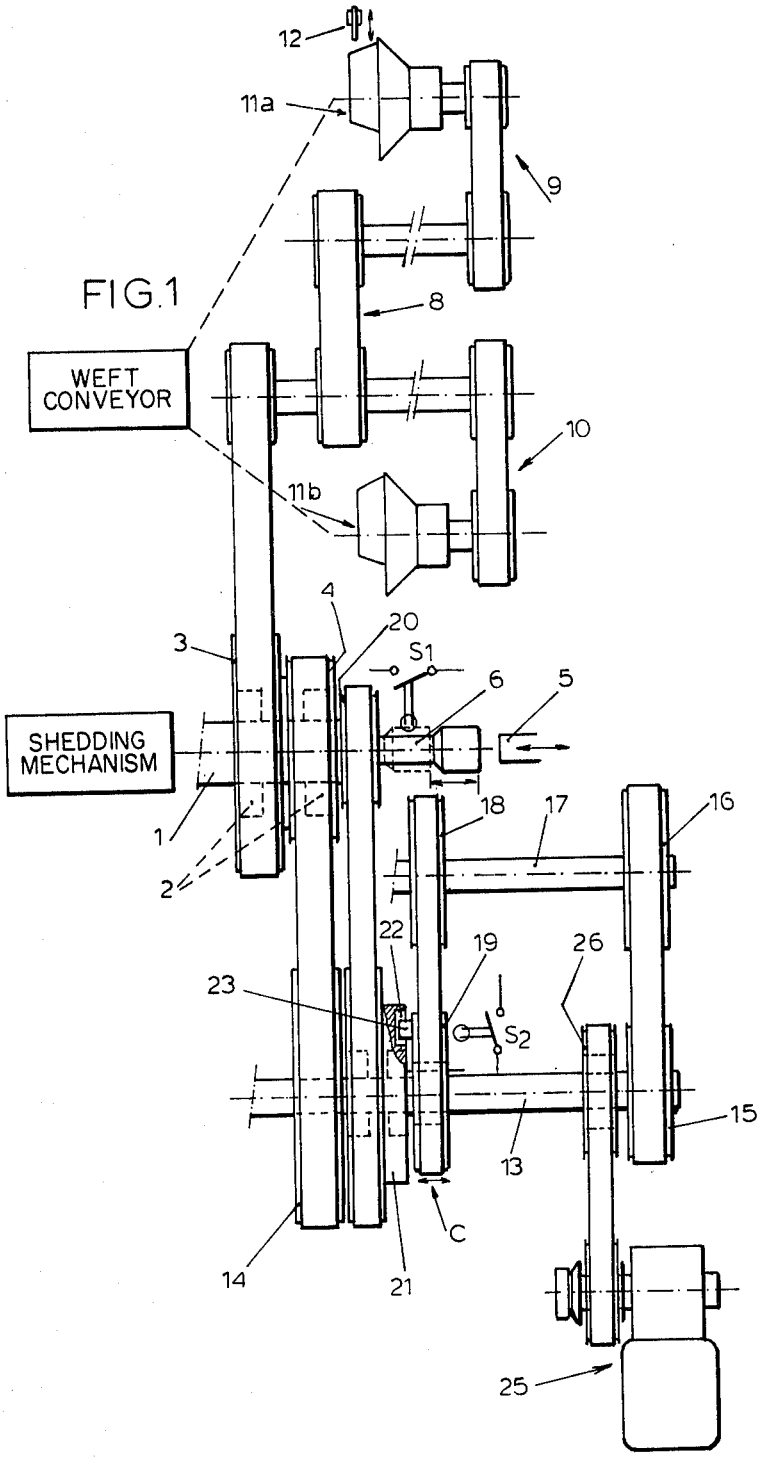

The invention relates to a shuttleless weaving machine of the type in which the weft threads are delivered according to a repeating pattern by a plural weft preparation device to a weft conveyor and are launched by said weft conveyor through the weaving shed, means being provided for disconnecting the coupling between the shedding mechanism of the machine and the weft preparation device and to move the shedding mechanism independently of the weft preparation device.

Such machines are known. The means for disconnecting the coupling between the shedding mechanism and the weft preparation device and for thereafter rotating (backwardly) the shaft of the shedding mechanism are e.g. used when a weaving eror is detected. In that case the shaft of the shedding mechanism is rotated (backwardly) through such an angle that the "faulty" weft thread may be released from the binding with the warp threads and may be removed from the weaving shed. If thereafter the coupling between the shedding mechanism and the weft preparation device would be simply reconnected and the weaving machine would be made to resume its normal operation an undesirable phase shift would occur between the weft pattern appearing in the cloth and the weft sequence of the different weft threads as delivered by the weft preparation device.

The invention aims at bringing about such provisions that a similar phase shift cannot occur, i.e. that the normal operation of the weaving machine may only be resumed after re-establishment of the synchronization of pattern sequence and weft sequence.

The purpose is achieved according to the invention in that between the shedding mechanism and the weft preparation device an angular position comparator is provided comprising two parts coupled to the shedding mechanism and the weft preparation device respectively, which parts assume during normal operation, with connected coupling, a marked angular position relative to each other and carry out per weaving cycle 1/an revolution (n indicating the number of wefts after which the weft pattern is repeated and a indicating the number of marked angular positions that are present), means being provided for detecting the relative angular position of both parts and for keeping disconnected the coupling between the weft preparation device and the shedding mechanism respectively, as soon as or as long as respectively the parts have a position differing from a marked relative angular position, and an auxiliary motor being further provided whereby the weft preparation device and the part of the angular position comparator coupled therewith may be rotated in order to bring both parts thereof again in the relative angular position corresponding with the synchronized condition.

In a practical embodiment the detection means are constituted by an axially directed snap claw or snap pin provided on one of the parts, said claw or pin during normal operation being in engagement with a corresponding recess in the other part and being axially moved if the relative angular position of both parts is changed, whereby the coupling between the weft preparation device and the shedding mechanism is disconnected or remains disconnected respectively.

In a preferably used embodiment the starting signal for the auxiliary motor is supplied to the auxiliary motor through an and-gate to which furthermore a signal is supplied which is representative for the condition of the coupling between the main drive and that of the weft preparation devices.

It is therewith preferable to insert into the start circuit of the auxiliary motor a means that is energized when the start circuit is closed, for disconnecting the coupling between the main drive and that of the weft preparation devices.

According to a further feature of the invention a slip coupling is provided between the auxiliary motor and the weft preparation devices.

The invention is hereunder further illustrated with reference to the drawing of an embodiment given as an example.

Figure 2:
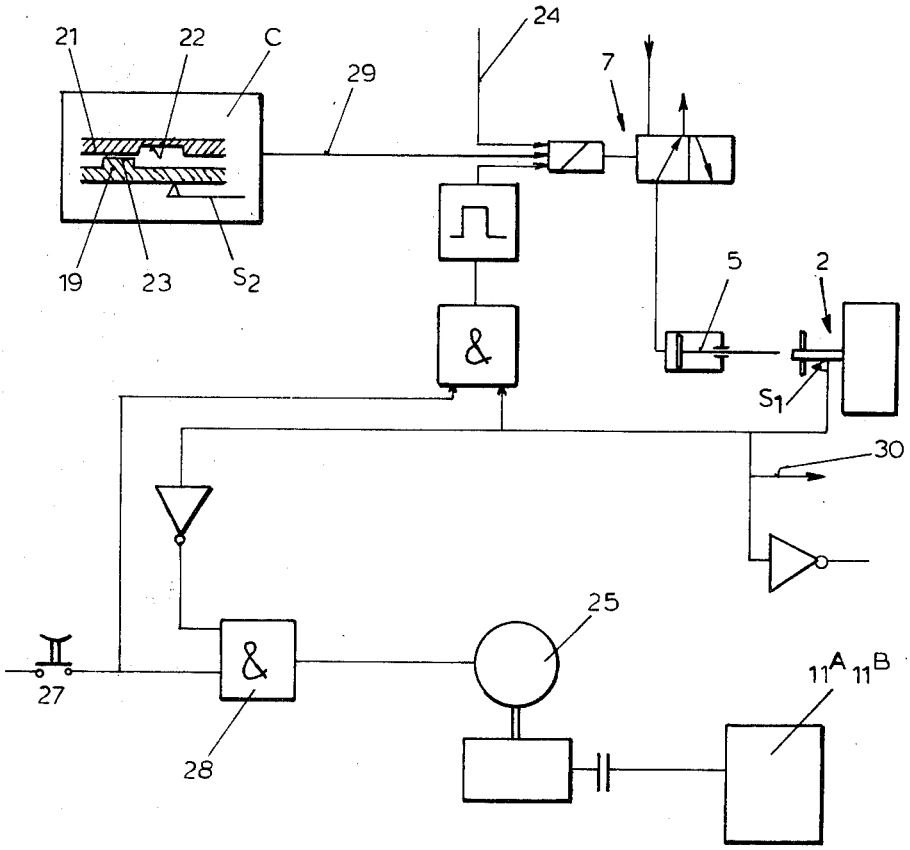

FIG. 1 shows a schematic arrangement of the weft preparation device and part of the drive mechanism of the weaving machine according to the invention and FIG. 2 shows the portion of the control circuit of the machine according to the invention, to which portion the invention is directed.

The starting point for the selected exemplified embodiment is an embodiment in which the control mechanism of the weaving leaves as well as of the reed is fixedly coupled to the main shaft of the weaving machine. The further constructional embodiment of the weaving leaves control mechanism and of the reed do not belong to the field of the invention. Therefore said portions of the weaving machine are not further illustrated.

The main shaft of the weaving machine is schematically shown in FIG. 1 and indicated by the reference number 1. A coupling is provided on the shaft 1 and its operative parts are schematically indicated 2. Through the intermediary of said coupling the coaxial pulleys 3 and 4, mutually secured, may be coupled to the shaft 1 or disconnected therefrom respectively. The coupling is thereto e.g. actuated by a plunger 5 which is reciprocatable in the direction of the shaft, through the intermediary of the link 6.

In the control circuit according to FIG. 2 the actuating plunger 5 is part of a pneumatic piston-cylinder device which may be supplied with pressurized air through a control valve 7 or may be vented respectively.

The link 6 cooperates with a feeler constituted by an electric switch S1 by means of which the condition of the coupling 2 is detected. In FIG. 1 the switch S1 is in its open condition corresponding with the connected condition of the coupling 2. By moving the plunger 5 in FIG. 1 to the left the link 6 arrives in the position indicated through broken lines and the coupling is disconnected while the switch S1 closes.

The shaft 1 drives the plural weft preparation device through the pulley 3 and a number of intermediate drives 8, 9 and 10. Said weft preparation device comprises in the embodiment shown two single weft preparation devices 11A and 11B of the so called drum type. For a detailed description of this type of weft preparation device reference is made to U.S. Pat. No. 4,372,349.

The intermediary drives 8, 9 and 10 have e.g. been dimensioned such that the upper weft preparation device 11A rotates with a number of revolutions that is 10/3 times the machine rpm (the rpm of the shaft 1), while the rpm of the lower weft preparation device 11B is 5/3 times the machine rpm. This means that per cycle of three revolutions of the main shaft the upper weft preparation device twice delivers a yarn packet corresponding to the weft thread and that the lower weft preparation device 11B once delivers such a yarn packet. The upper weft preparation device 11A comprises the intermittently operative blocking means 12 which is described in detail in the above mentioned patent. Thereby is achieved that both yarn packets are delivered at the correct moments namely with intervals of alternately one and two machine revolutions respectively. The phase ratio between both weft preparation devices 11A and 11B therewith is such that with both devices the weft pattern A-A-B-A-A-B . . . is obtained. The number of wefts n whereafter the weft pattern is repeated amounts in this case therefore to 3.

The pulley 4 secured to the pulley 3 drives through the pulleys 14 and 15 secured to an intermediate shaft 13 and through the pulley indicated 16 the cam shaft 17. The pulleys 4, 14, 15 and 16 have been dimensioned such that with connected coupling 2 the cam shaft 17 rotates with $\frac{1}{3}$ of the number of machine rpm. The cam shaft 17 drives through a pulley 18 mounted thereon the one part 19 of the angular position comparator C proposed according to the invention. The part 19 is constituted by a disc mounted idly rotatable and somewhat slidable in axial direction to the intermediate shaft 13, which disc will further below be named "synchronization wheel". The transmission ratio between the pulley 18 and the synchronization wheel 19 is 1:1 so that the synchronization wheel 19 permanently follows the movements of the weft preparation device with a deceleration of 1:3 from the shaft 1.

A pulley 20 is secured to the shaft 1 which pulley drives a second synchronization wheel 21, likewise journalled on the intermediate shaft 13. This synchronization wheel 21 constitutes the second part of the angular position comparator according to the invention and is permanently connected with the main shaft 1 and therefore with the shedding mechanism and the reed of the weaving machine. Driving the second synchronization wheel 21 likewise takes place with a deceleration of 1:3 from the shaft 1.

The synchronization wheel 21 is provided at its side facing the synchronization wheel 19 with a recess 22 cooperating with a roller 23 mounted on the facing side of the synchronization wheel 19. The synchronization wheel 19 is pressed by a spring device not shown in the drawing against the synchronization wheel 21.

During normal operation, i.e. with connected coupling 2, the roller 23 is situated opposite to the recess 22 and the synchronization wheels 19 and 21 are pressed into mutual engagement with the side surfaces. The plural weft preparation device then rotates synchronously with the shedding mechanism and with the reed of the weaving machine. So this condition is marked by the mutual engagement of the synchronization wheels 19 and 21 and is, moreover, signalled by a feeler constituted by an electric switch $S_2$ which then is open.

With disconnected coupling 2 the synchronization wheels 19 and 21 are permitted to rotate relative to each other. The synchronization wheel 19 is then pressed away from the synchronization wheel 21 and as a result thereof the switch $S_2$ closes (see the condition of the angular position comparator C upper left in the scheme of FIG. 2).

Assuming now that a weaving error has been established by a detection device adapted thereto, as a result of which the weaving machine has been stopped, then it will be necessary in order to rectify this weaving error to cancel the binding of the weft threads which is responsible for the established weaving error. In order therewith not to deregulate the weft yarn preparation the weft yarn preparation device must not take part in said retrograde movement. It is well known to make use of an auxiliary drive, which may be started by hand or foot, for rotating backwardly the main machine, whereby the reed, the shedding mechanism and the further parts of the main machine may be moved backwardly slowly and jerkingly. However, prior to the actual starting of the auxiliary drive the electromagnetic control valve 7 is actuated through the signal entered by the hand or the foot (see the signal 24 in the scheme of FIG. 2, whereby the disconnection plunger 5 is energized and the coupling 2 is disconnected).

If in this way, while the weft preparation device 11A, 11B is at standstill, the main machine has been rotated backwardly through such an angle that the faultive weft thread may be removed, the weft preparation device has to be returned to the same position with respect to the main machine before the normal weaving operation may be resumed. For the redress of this position the auxiliary motor indicated 25 is meant. The synchronization wheel 19 may be driven in forward direction through this auxiliary motor through the pulley 26, the intermediate shaft 13 and the pulleys 15, 16 and 18.

Assuming that the shaft 1 (that is of the main machine) has been rotated backwardly for cancelling the established weaving error to a half revolution. Then the synchronization wheel 21 has been rotated backwardly through 1/6 revolution with respect to the synchronization wheel 19 which has remained at standstill when rotating the main machine backwardly. In order then to redress the normal weaving operation the auxiliary motor 25 is switched on in order to drive the synchronization wheel 19 in forward direction with respect to the synchronization wheel 21, being at present at standstill. Starting the auxiliary motor 25 takes place by pressing the switch 27 (see the control circuit of FIG. 2). The start singal generated thereby is supplied to an and-gate 28 to which, moreover, a signal is supplied which is representative for the condition of the coupling 2. So long the coupling 2 is disconnected and therefore the switch $S_1$ is closed the last mentioned signal will be positive so that the and-gate issues a positive energization signal to the motor 25.

As soon as now the synchronization wheel 19 has rotated through 5/6 revolution the snap claw 23 has again arrived opposite to the recess 22 of the synchronization wheel 21. Both synchronization wheels 19 and 20 then are again pressed against each other whereby the switch $S_2$ opens. Thereby the signal 29 whereby the disconnection plunger is energized through the electromagnetic control valve 7 and the coupling 2 was disconnected is removed. Since the signal 24 had already been previously removed, the energization of the disconnecting plunger 5 is cancelled so that the coupling 2 may connect. This connection takes place at the moment in which the pulleys 3 and 4 have been rotated through $2\frac{1}{2}$ revolution relative to the stationary shaft 1 in forward direction. Thereby the weft preparation device and the shedding mechanism have arrived in exactly the same mutual positions as they took prior to the occurrence and the signalization of the weaving error. When the coupling 2 is connected the relative signal to the and-gate 28 is removed and the auxiliary motor 25 is stopped, also should the switch 27 remain activated.

At this moment the machine is again in the condition in which the main drive may be started. The signal 30 (see the scheme of FIG. 2) which locked the starting of the main drive during the actions as described above, has been removed by opening the switch $S_1$.

In order to prevent that during normal operation the auxiliary motor 25 might be driven through the intermediate shaft 13 the pulley 26 has been mounted on the intermediate shaft 13 through a slip coupling.

I claim:

1. A shuttleless weaving machine having a shedding mechanism, a weft conveyor for launching a weft thread through a weaving shed provided by the shedding mechanism, a plural weft preparation device for delivering weft threads according to a repeating pattern to the weft conveyor, and a disconnectable coupling between the plural weft preparation device and the shedding mechanism, wherein the improvement comprises an angular position comparator which includes a part coupled to the shedding mechanism and a part coupled to the plural weft preparation device, said parts assuming a marked angular position relative to each other during normal operation while rotating through 1/(an) revolution per weaving cycle (a=number of wefts after which the weft pattern is repeated, and n=number of marked angular positions), means for detecting such marked relative angular position of the two parts, said means operating, while such position is not detected, to disconnect said coupling, and an auxiliary motor connected to the plural weft preparation device, for driving said device and the part of the comparator coupled thereto to bring said part to a marked angular position relative to said other part.

2. Weaving machine according to claim 1, characterized in that the detection means are constituted by a detent provided on one of the parts and axially directed, said detent engaging during normal operation with a corresponding recess in the other part and being axially moved when the relative angular position of both parts is changed, whereby the coupling between the weft preparation device and the shedding mechanism is disconnected.

3. Weaving machine according to claim 1 characterized in that the starting signal for the auxiliary motor is supplied through an and-gate to which likewise a signal is supplied which is generated by disconnection of the coupling between the weft preparation device and the shedding mechanism.

* * * * *